US006308896B1

(12) United States Patent
Moroi et al.

(10) Patent No.: US 6,308,896 B1
(45) Date of Patent: Oct. 30, 2001

(54) HEAT GENERATOR AND DESIGN METHOD THEREOF

(75) Inventors: Takahiro Moroi; Shigeru Suzuki; Masami Niwa; Tatsuyuki Hoshino, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/575,065

(22) Filed: May 19, 2000

(30) Foreign Application Priority Data

Jun. 25, 1999 (JP) ..... 11-179982

(51) Int. Cl.[7] ..... B60H 1/02
(52) U.S. Cl. ..... 237/12.3 R; 122/26; 126/247
(58) Field of Search ..... 237/12.3 R, 12.3 B; 122/26; 126/247; 123/142.5 R

(56) References Cited

U.S. PATENT DOCUMENTS 4,974,778 12/1990 Bertling ..... 237/12.3 B
5,816,236 10/1998 Moroi et al. ..... 126/247
5,871,149 * 2/1999 Moroi et al. ..... 237/12.3 R
5,901,670 * 5/1999 Moroi et al. ..... 122/26
5,904,120 * 5/1999 Ban et al. ..... 122/26
5,911,361 * 6/1999 Suzuki et al. ..... 237/12.3 R
5,915,341 * 6/1999 Moroi et al. ..... 122/26
5,937,797 * 8/1999 Ban et al. ..... 122/26

* cited by examiner

*Primary Examiner*—Harold Joyce
*Assistant Examiner*—Derek S. Boles
(74) *Attorney, Agent, or Firm*—Woodcock Washburn Kurtz Mackiewicz & Norris LLP

(57) ABSTRACT

A heat generator comprises a partitioning wall 34 in opposed relation to a rotor in a heat generating area, in which the partitioning wall is formed with a supply groove 38 for introducing the viscous fluid to the outer peripheral area of the heat generating area from a storage area, and a recovery groove 39 for leading out the viscous fluid to the storage area from the outer peripheral area of the heat generating area. The shape, position and the mounting angle of the supply groove 38 and the recovery groove 39 are designed to set the outflow ratio α to not more than 0.92. The outflow ratio α is defined as the ratio (α=Qout1/Qin) of the amount Qout1 of the viscous fluid flowing out from the heat generating area due to the forcible transfer function of the recovery groove 39 to the total amount Qin of the viscous fluid flowing from the storage area into the heat generating area.

10 Claims, 8 Drawing Sheets

HEAT GENERATOR AND DESIGN METHOD THEREOF

BACKGROUND OF THE INVENTION

1. Field of the Invention

The present invention relates to a heat generator comprising a working chamber defined in a housing, a viscous fluid accommodated in the working chamber, and a rotor rotationally driven by an external power source. More in particular, the invention relates to a heat generator in which the working chamber includes a heat generating area for accommodating the rotor in such a manner as to secure a fluid-tight gap between the partitioning wall thereof and the rotor for generating the heat by shearing the viscous fluid, existing in the fluid-tight gap, with the rotor, a storage area for accommodating viscous fluid beyond the volume of the fluid-tight gap, and at least one opening in the boundary between the heat generating area and the storage area for communicating between the two areas.

2. Description of the Related Art

A heat generator comprising a viscous fluid (hereinafter referred to as the oil) such as silicone oil sealed in a fluid-tight heat generating chamber defined in a housing in which heat is generated by fluid friction as the oil is sheared by a rotor is known as an auxiliary heat source of an automotive heating system (see, for example, Japanese Unexamined Patent Publication No. 2-246823). In this type of heat generator, the oil constantly subjected to shearing degenerates quickly and the heat generating performance cannot be maintained for a long time. For this reason, a heat generator mechanically designed to prevent or delay oil degeneration as much as possible has been proposed.

An example is a viscous heater (heat generator), disclosed in Japanese Unexamined Patent Publication No. 10-95224, comprising a heat generating chamber and a storage chamber in the housing. The partitioning wall between the heat generating chamber and the storage chamber is formed with at least a recovery hole (recovery path) and at least a supply hole (supply path), through which the viscous fluid is replaced and circulated between the heat generating chamber and the storage chamber. The replacement/circulation avoids the case in which specific oil molecules are subjected to protracted continuous shearing, and allows the viscous oil to rest in the storage chamber to recover its original viscoelasticity. Thus, oil degeneration is delayed. Further, the heat generator described in the same patent publication comprises at least a recovery groove and at least a supply groove extending substantially along the diameter in the inner wall surface of the heat generating chamber in an opposed relation to the shearing surface of the rotor. The recovery groove is for leading the oil from the outer peripheral area of the rotor to the recovery hole, and the supply hole is for leading the oil from the supply hole to the outer peripheral area of the rotor. The recovery groove and the supply groove promote the oil outflow from the heat generating chamber and the oil inflow from the storage chamber to the heat generating chamber to thereby improve the efficiency of the replacement/circulation.

As described above, some patent publications already disclose an idea of an oil shearing type of heat generator comprising a recovery groove (and a recovery path) and a supply groove (and a supply path) formed in the partitioning wall between a heat generating chamber and a storage chamber to promote the replacement/circulation of the oil. Nevertheless, the conditions for arranging the grooves and paths for securing the required heat generating ability while replacing and circulating the oil have yet to be theoretically analyzed or studied in depth. It has thus far been very difficult, therefore, to reflect the idea in the actual machine and commercialize it. Even if the desirable conditions of arrangement have been discovered in the stage of developing a working model of the product, it has been the incidental result of trial and error.

SUMMARY OF THE INVENTION

The object of the present invention is to provide a heat generator and a design method for the heat generator in which the factors for determining the desirable conditions for the arrangement of the grooves and paths formed in the partitioning wall between a heat generating area and a storage area are clarified thereby to secure the replacement/circulation of the viscous fluid between the heat generating area and the storage area and the heat generating performance of the viscous fluid at the same time.

According to the present invention, there is provided a heat generator comprising a working chamber defined in a housing, a viscous fluid accommodated in the working chamber, and a rotor rotationally driven by an external power, wherein the working chamber includes a heat generating area for accommodating the rotor in such a manner as to secure a fluid-tight gap between the partitioning wall and the rotor and generates heat by shearing the viscous fluid existing in the fluid-tight gap by rotation of the rotor, a storage area for accommodating the viscous fluid exceeding the volume of the fluid-tight gap, and at least one opening formed in the boundary between the heat generating area and the storage area for communicating the two areas, wherein the working chamber includes supply means for transferring the viscous fluid in the storage area to the heat generating area at the time of rotation of the rotor and recovery means for transferring the viscous fluid in the heat generating area to the storage area at the time of rotation of the rotor, wherein the recovery means includes at least a recovery groove formed in the partitioning wall of the working chamber in opposed relation to the shearing surface of the rotor for trapping the viscous fluid existing in the fluid-tight gap and forcibly transferring the viscous fluid toward the opening at the time of rotation of the rotor, and wherein the supply means and the recovery means are so constructed that the outflow ratio ($\alpha$), i.e. the ratio of the amount of the viscous fluid flowing out of the heat generating area due to the forcible transfer function of the recovery groove to the total amount of the viscous fluid flowing into the heat generating area from the storage area due to the transfer function of the supply means is not more than 0.92.

In this heat generator, the replacement/circulation of the viscous fluid occurs between the storage area and the heat generating area, through the opening, at the time of rotation of the rotor by the cooperation between the supply means and the recovery means arranged in the working chamber. The heat generating performance can be maintained for a long time as the result of the continued replacement/circulation with the flow rate of the viscous fluid into the heat generating area and the flow rate of the viscous fluid out of the heat generating area in equilibrium. The mere equilibrium between the flow rate of the viscous fluid into and out of the heat generating area, however, cannot necessarily exhibit the maximum heat generating performance of the heat generator. The outflow ratio ($\alpha$) defined here provides a new index of characteristic evaluation (or a design measure) permitting the heat generating performance in the heat generating area to be set at the desired level while making possible both the proper replacement/circulation of the viscous fluid and a suitable equilibrium between the inflow and outflow of the viscous fluid in the heat generating area. It has been substantiated by experiments conducted on working models that this outflow ratio $\alpha$ has a predetermined relationship with the heat generation amount and provides an influential index for controlling the filling ratio (or occupancy) of the viscous fluid in the fluid-tight gap of the heat generating area while holding the balance between inflow and outflow of the viscous fluid in the heat generating area (refer to the DESCRIPTION OF THE PREFERRED EMBODIMENTS and FIG. 9).

The concept of the outflow ratio $\alpha$ has been created from the theoretical analysis of the transfer balance and the transfer driving force of the viscous fluid between the storage area and the heat generating area. A typical example of the discussion of the transfer balance concerns the fact that the ratio (Qout/Qin) of the total amount Qout of the viscous fluid flowing out of the heat generating area through the recovery means to the total amount Qin of the viscous fluid flowing into the heat generation area through the supply means is unity in the case where the total inflow amount and the total outflow amount is in equilibrium. The recovery means of the heat generator according to this invention includes a recovery groove as described above, and the transfer operation of the viscous fluid from the heat generating area to the storage area by the recovery means is divided into the forcible transfer function inherent in the recovery groove and a pressure function other than the forcible transfer function (such as the operation based on the pressure difference between the liquid phase portion of the heat generating area and the gas phase portion of the storage area). The outflow rate due to the forcible transfer function of the recovery groove can be determined (calculated) uniquely by specifying the shape, position and the mounting angle of the recovery groove. The outflow rate due to the pressure function, on the other hand, is a subsidiary factor liable to change conspicuously due to the filling ratio of the viscous fluid in the heat generating area and so forth. Out of the total outflow rate Qout by the recovery means, the outflow rate $\Sigma$Qout1(n) due to the forcible transfer function of the recovery groove that can be specified theoretically is taken into account, and divided by the total inflow rate Qin to define the outflow ratio $\alpha$ (i.e. $\alpha=\Sigma Qout1(n)/Qin$), where $\Sigma$Qout1(n) should be considered substantially as an integrated outflow rate due to the force transfer functions of a plurality of (n) types, if any, of recovery grooves having different shapes, etc.

By setting the transfer ability of the supply means and the transfer ability of the recovery means (especially, the recovery groove) so that the outflow ratio $\alpha$ is not more than 0.92, the heat generating performance (or the heat generating efficiency) in the heat generating area can be set to not less than the required level while at the same time securing both the equilibrium between the flow rates of the viscous fluid into or out of the heat generating area and the proper replacement/circulation at the same time.

The present invention may be more fully understood from the description of preferred embodiments of the invention set forth below, together with the accompanying drawings.

DESCRIPTION OF THE PREFERRED EMBODIMENTS

A heat generator for automotive vehicles according to embodiments of the invention will be explained below.

(First embodiment)

Figure 1:
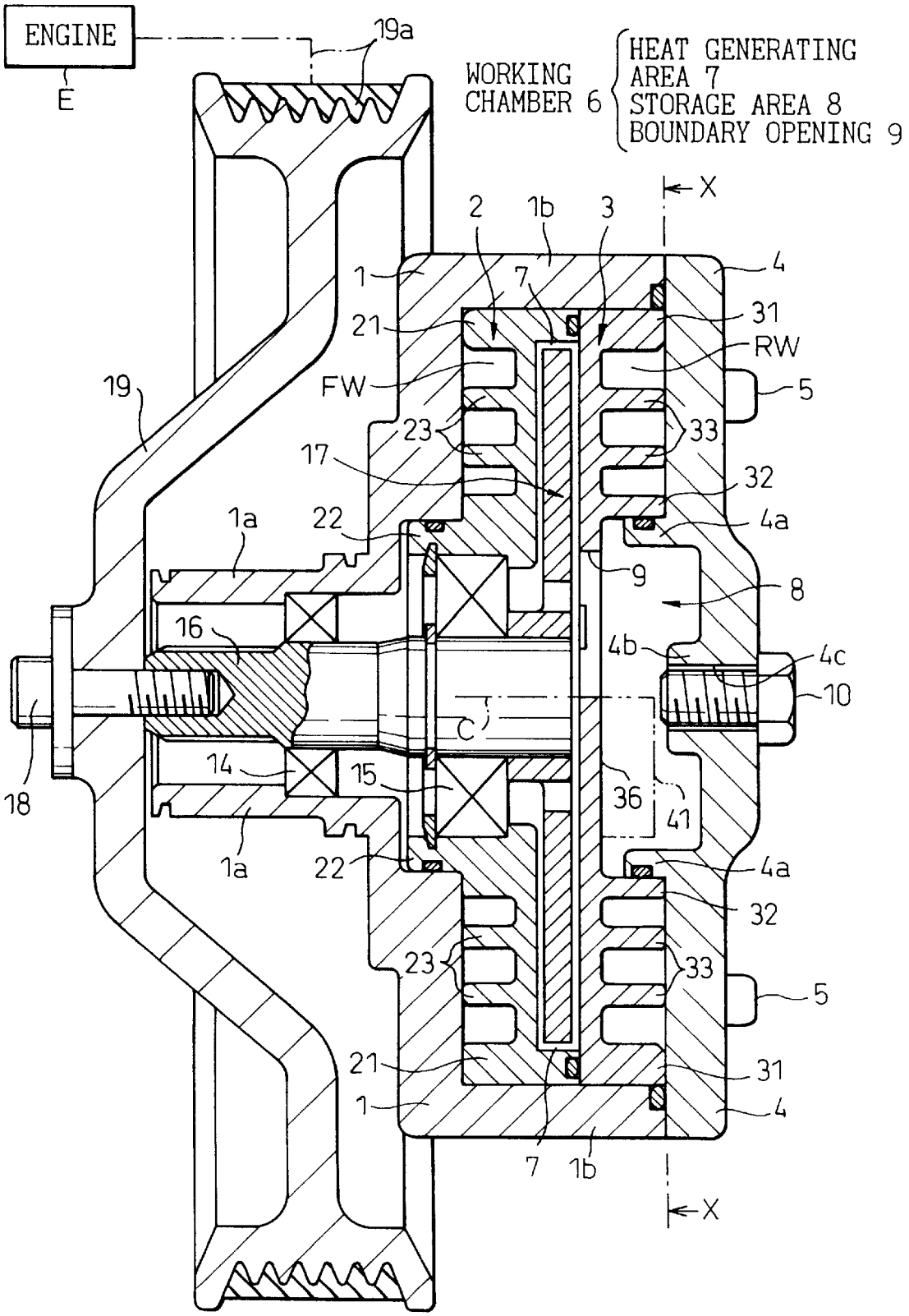
FIG. 1 is a longitudinal sectional view of a heat generator for automobiles according to a first embodiment of the invention.

As shown in FIG. 1, an automotive heat generator comprises a front housing body 1, a front partitioning plate 2, a rear partitioning plate 3 and a rear housing body 4, all of which make up a housing of the heat generator.

The front housing body 1 includes a hollow cylindrical boss 1*a* protruded forward and a cylindrical portion 1*b* extending in large arcuate form rearward from the base end of the boss 1*a*. The rear housing body 4 is in the form of a lid covering the opening of the cylindrical portion 1*b*. The front housing body 1 and the rear housing body 4, with the front partitioning plate 2 and the rear partitioning plate 3 mounted in the cylindrical portion 1*b* of the front housing body 1, are coupled to each other by a plurality of bolts 5. The front partitioning plate 2 and the rear partitioning plate 3 each have annular rims 21, 31 on the outer peripheral portion thereof. The rims 21, 31 are held between the housing bodies 1, 4 coupled to each other by the bolts 5 so that the partitioning plates 2, 3 are immovably accommodated in the housing.

Figure 4:
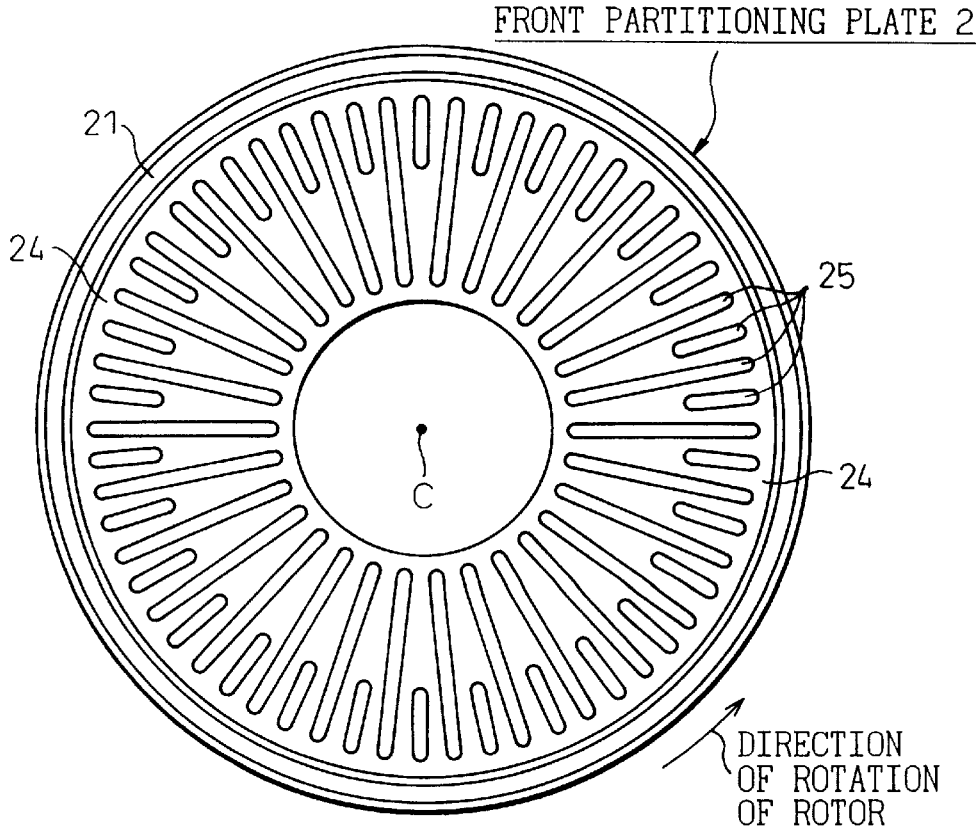
FIG. 4 is a side view of a front partitioning plate when it is viewed from the rear side thereof.

The rear end of the front partitioning plate 2 is recessed at an opposite side of the rim 21 and, by taking advantage of the recess, the heat generating area 7 of the working chamber 6 is defined between the front and rear partitioning plates 2, 3. At the rear end of the front partitioning plate 2, an end surface (rear end surface) 24 corresponding to the bottom of the recess is formed (FIG. 4). This end surface 24 functions as a partitioning wall for defining the working chamber 6. As shown in FIG. 1, the front partitioning plate 2 includes a support cylinder portion 22 formed toward the center of the plate at the front end side and a plurality of guide fins 23 formed in concentric arcs extending in the circumferential direction along the outer peripheral surface of the support cylinder portion 22. The front partitioning plate 2 has a portion of the support cylinder 22 fitted in the front housing body 1 in close contact with the inner wall portion of the front housing body 1. As a result, a front water jacket FW constituting a heat radiation chamber is defined adjacent to the front side of the heat generating area 7 of the working chamber between the inner wall portion of the front housing body 1 and the body of the front partitioning plate 2. In this front water jacket FW, the rim 21, the support cylinder 22 and the guide fins 23 function as a wall for guiding the flow of the circulation water (such as the engine cooling water) as a circulation fluid, and set the flow path of the circulation water in the front heat radiation chamber FW.

Figure 2:
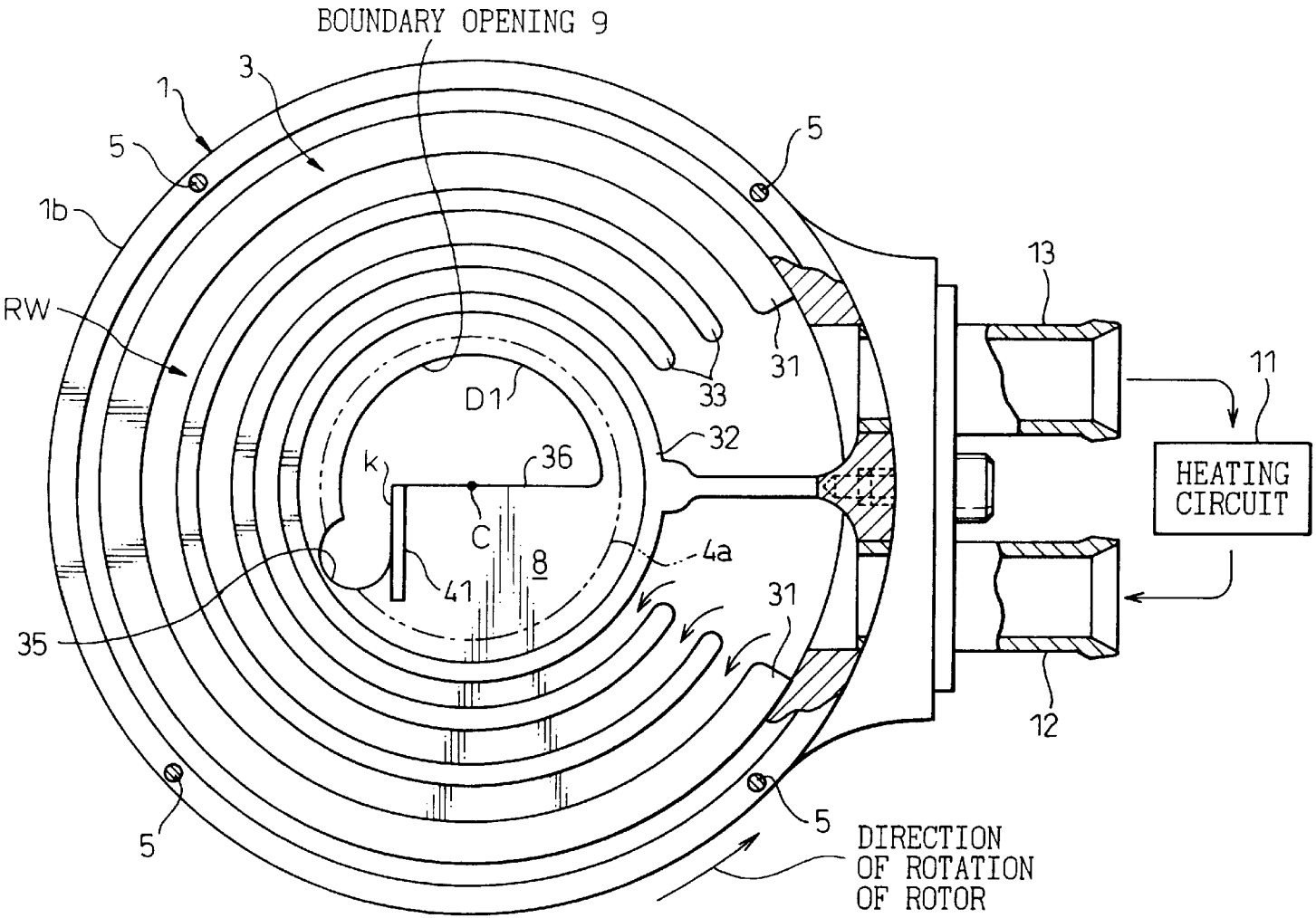
FIG. 2 is a cross sectional view taken in line X—X in FIG. 1.
Figure 5:
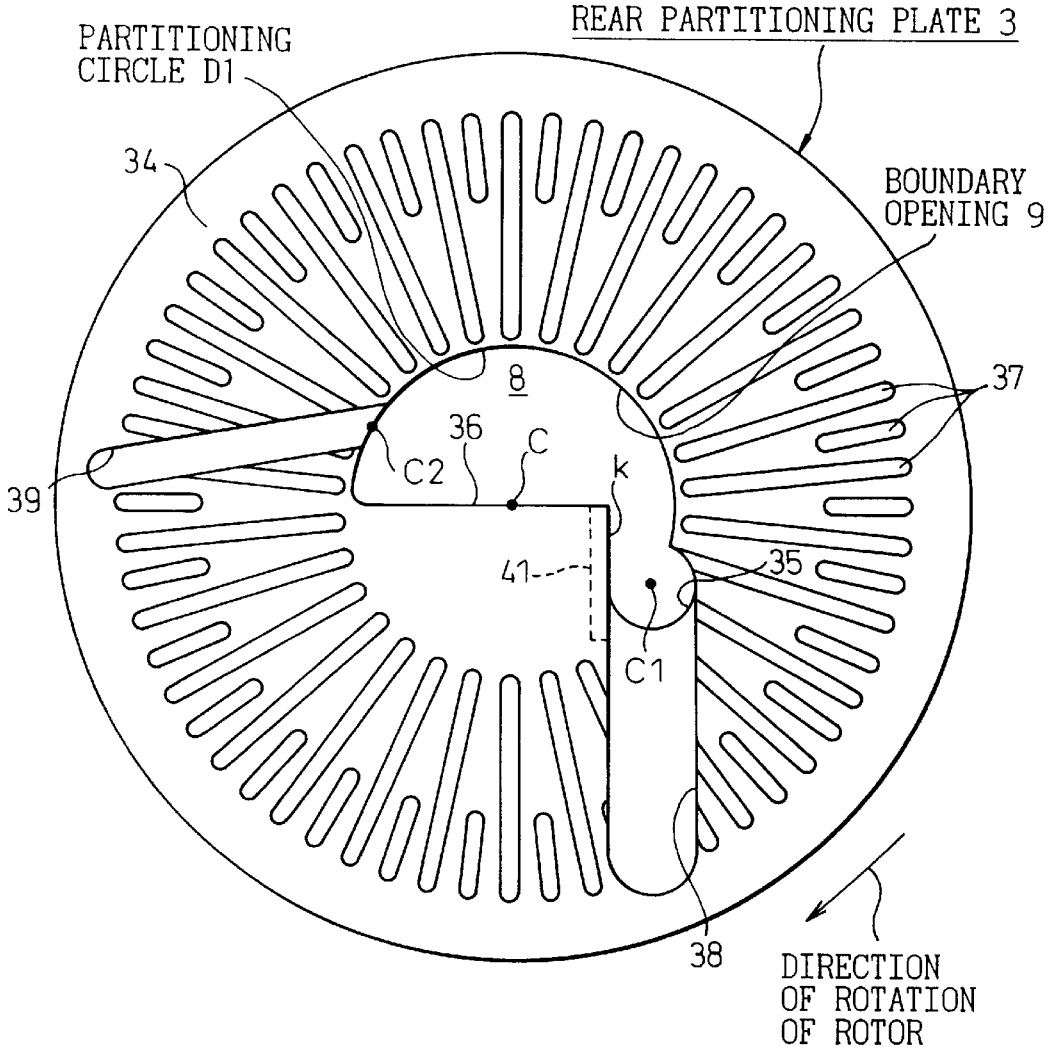
FIG. 5 is a side view of a front partitioning plate when it is viewed from the rear side thereof.

As shown in FIGS. 1 and 2, the rear partitioning plate 3, in addition to the rim 31 at the rear end thereof, includes a cylindrical portion 32 formed toward the plate center, and a plurality of guide fins 33 formed in concentric arcs extending in the circumferential direction along the outer peripheral surface of the cylindrical portion 32. With the partitioning plates 2, 3 held between the front and rear housings 1, 4, the cylindrical portion 32 of the rear partitioning plate 3 is in close contact with the annular wall 4*a* of the rear housing body 4. As a result, a rear water jacket RW making up a heat radiation chamber adjacent to the rear side of the heat generating area 7 of the working chamber and the storage area 8 of the working chamber 6 located in the cylindrical portion 32 is defined between the body of the rear partitioning plate 3 and the rear housing body 4. In this rear water jacket RW, the rim 31, the cylindrical portion 32 and the guide fins 33 function as a wall for guiding the flow of the circulation water making up a circulation fluid, and set a flow path of the circulation water in the rear heat radiation chamber RW. Further, an end surface (front end surface) 34 is formed at the forward end of the rear partitioning plate 3 (FIG. 5). This end surface functions as a partitioning wall for the working chamber 6.

As shown in FIG. 2, a lead-in port 12 for introducing the circulation water from the heating circuit 11 of the air-conditioning system in the vehicle to the front and rear water jackets FW, RW, and a lead-out port 13 for leading out the circulation water from the front and rear water jackets FW, RW to the heating circuit 11 are juxtaposed on the side wall of the front housing body 1. The circulation water circulates between the two water jackets FW, RW and the heating circuit 11 of the heat generator through these ports.

As shown in FIG. 1, the front housing body 1 and the front partitioning plate 2 have the drive shaft 16 rotatably supported through the bearings 14, 15. The bearing 15 interposed between the inner peripheral surface of the support cylinder 22 and the outer peripheral surface of the drive shaft 16 is a bearing with a seal and seals the front portion of the heat generating area 7. A substantially disk-shaped rotor 17 is fixedly fitted in the rear end portion of the drive shaft 16. This rotor 17 is arranged in the heat generating area 7 to secure a minuscule clearance (fluid-tight gap) between the front end surface (shearing surface) of the rotor and the rear end surface 24 of the front partitioning plate 2 and between the rear end surface (shearing surface) of the rotor and the front end surface 34 of the front partitioning plate 3.

Figure 3:
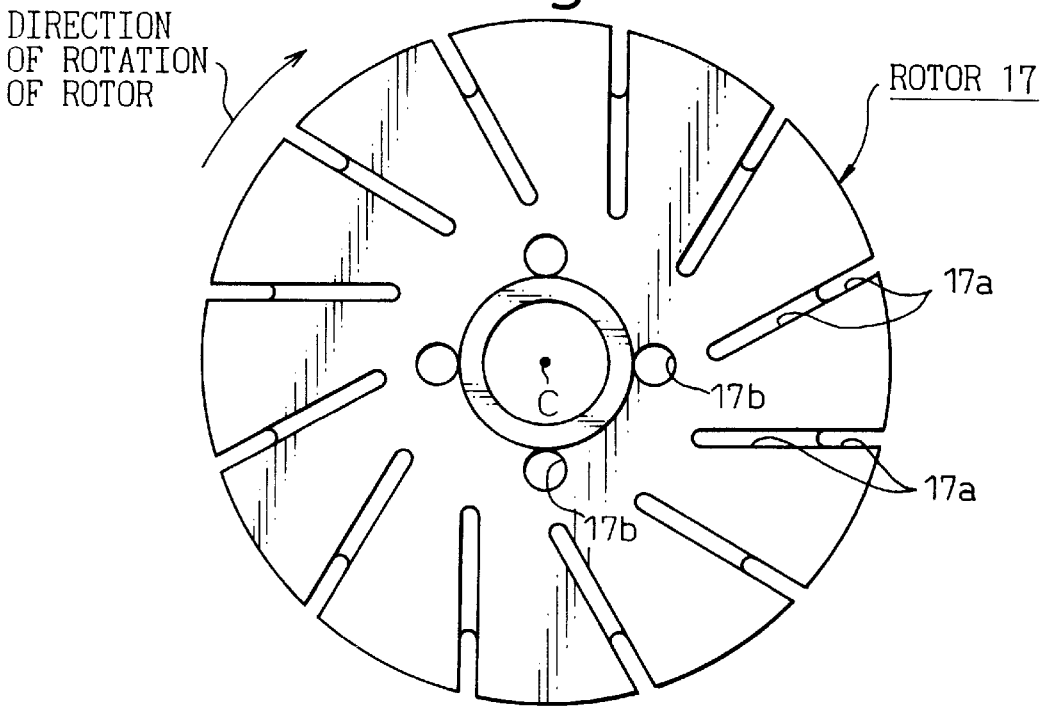
FIG. 3 is a front view of a disk rotor.

As shown in FIG. 3, the disk portion of the rotor 17 is formed with a plurality of grooved recesses 17*a* slightly inclined in the radial direction. Each grooved recess 17*a* forms a groove in the portion thereof near to the center and a definite notch in the portion thereof near to the outer periphery. The grooved recess 17*a* improves the shearing effect of the viscous fluid in the heat generating area 7 with the rotation of the rotor 17, while at the same time promoting the transfer of the viscous fluid to the outer periphery of the heat generating area. Further, a plurality of communication holes 17*b* are formed longitudinally through the rotor in the vicinity of the center of the rotor 17. These communication holes 17*b* facilitate the movement of the viscous fluid before and after the heat generating area with the rotor therebetween.

As shown in FIG. 1, a pulley 19 is fixed by a bolt 18 at the forward end portion of the drive shaft 16. The pulley 19 is operatively coupled to the vehicle engine E providing an external drive source through a belt 19*a*. Thus, as the engine E is driven, the rotor 17 is rotationally driven through the pulley 19 and the drive shaft 16. The sectional shape of the rotor 17, the heat generating area 7 and the storage area 8 perpendicular to the rotary axis C of the drive shaft 16 are concentric about the rotary axis C.

As shown in FIGS. 1, 2 and 5, the central area of the rear partitioning plate 3 is formed with a boundary opening 9 for communicating the heat generating area 7 and the storage area 8 in the boundary area between the areas 7 and 8. The areas 7, 8 and the boundary opening 9 make up a working chamber 9. Further, as shown in FIG. 1, the central portion of the rear housing body 4 is protruded rearward to increase the capacity of the storage area 8 as much as possible, and a central protrusion 4*b* is formed inward of the storage area 8 from the front of the housing body 4 at the central portion of the rear housing body 4. This central protrusion 4*b* is formed with an injection hole 4*c* therethrough communicating the storage area 8 with the exterior. This injection hole 4*b* is for injecting the required amount of silicone oil (viscous fluid) into the working chamber 6 using an injector (not shown) and, after the oil is injected, is closed by the bolt 10 through a seal washer. The last half portion of the storage area 8 forms an annular recessed area defined by the inner peripheral surface of the annular wall 4*a,* the outer peripheral surface of the central protrusion 4*b* and the front surface of the rear housing body 4.

As shown in FIGS. 2 and 5, the boundary opening 9 is generally semicircular in shape, and the arcuate outline thereof is formed along the partitioning circle D1 of a predetermined radius about the rotary shaft axis C. The radius of the partitioning circle D1 is in the range of 3/10 to 5/10 (or more preferably about 4/10) of the radius of the rotor 17. A substantially circular transfer opening 35 extending out of the partitioning circle D1 is formed as a notch in the rear partitioning plate 3 at an arcuate end of the boundary opening 9. On the other hand, a substantially square protruded wall 36 is protruded from the inner peripheral surface of the cylindrical portion 32 of the rear partitioning plate 3. The height of the protrusion of the protruded wall 36 substantially corresponds to the radius of the partitioning circle D1. In other words, the remainder of the partitioning circle D1, after allowing for the protruded wall 36, constitutes the boundary opening 9 (including the transfer opening 35).

Figure 6:
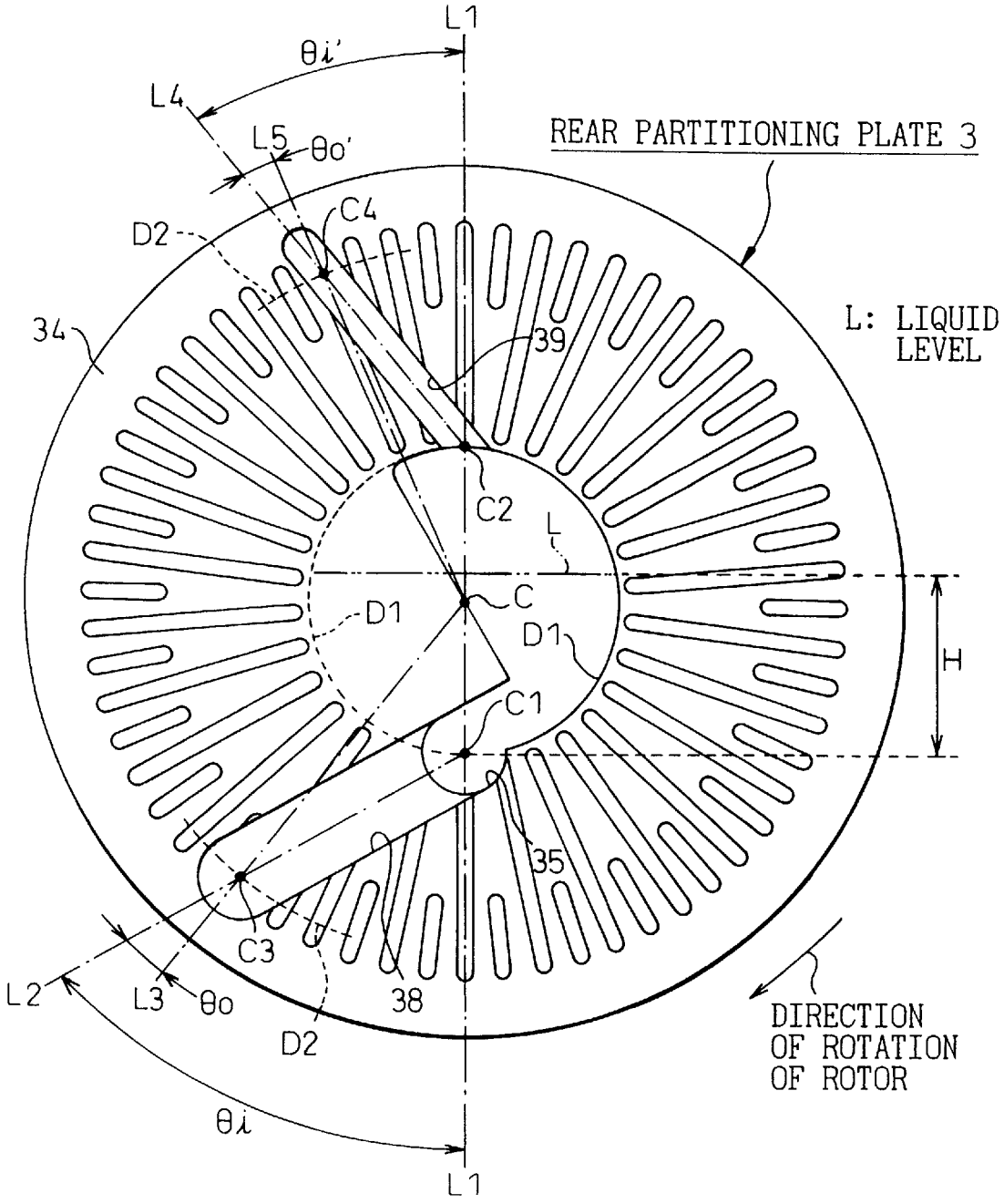
FIG. 6 is a front view of a rear partitioning plate taken from the front end when mounted on the vehicle body.

In the case where the required amount of silicone oil is put in the working chamber 6, the oil existing in the heat generating area 7 and the oil in the storage area 8 communicate with each other through the portion of the boundary opening 9 below the oil level L (FIG. 6). Thus, the boundary opening 9 below the oil level L transfers the rotational effect of the rotor 17 from the oil in the heat generating area 7 to the oil in the storage area 8, thus providing substantially a rotation transmitting liquid phase unit for causing a free-running oil flow in the storage area.

The protruded wall 36 has a side portion k adjacent to the transfer opening 35. This side portion k is located downstream of the transfer opening 35 in the silicone oil flowing in the storage area 8. As a result, the side portion k functions as a guide for changing the direction of oil flow in the storage area 8 and leading the silicone oil to the heat generating area 7 through the transfer opening 35.

Further, as shown in FIGS. 1, 2 and 5, a screen 41 is arranged in the storage area 8 in addition to the side portion k of the protruded wall 36. The screen 41 is protruded rearward from the side portion k on the back (surface on the storage area 8 side) of the protruded wall 36. The screen 41 extends in the same direction as the supply groove (FIG. 5) and, at the same time, has an axial length somewhat shorter than the axial length of the storage area 8 as shown in FIG. 1. With the rotation of the rotor 17, the free-running silicone oil flow in the storage area 8, upon bombarding the screen 41, changes to the axial direction along the screen. Thus, the silicone oil is transferred forcibly toward the transfer opening 35. Specifically, the screen 41 also functions as a guide for leading the silicone oil through the transfer opening 35 to the heat generating area 7 by changing the direction of oil flow impacting on the screen 41 in the storage area 8. Thus, the screen 41 supports the function of the side portion k of the protruded wall 36.

As shown in FIG. 5, a multiplicity of radially extending effect improving grooves 37 are formed as recesses about the rotary axis C at the front end surface 34 of the rear partitioning plate 3. These effect improving grooves 37 are formed as alternately short and long adjacent grooves in such positions that the interval between the adjacent grooves 37 is comparatively small on the outer peripheral area of the heat generating area 7. These effect improving grooves 37 improve the effect of the rotor 17 for shearing the silicone oil existing in the fluid-tight gap of the heat generating area 7, while at the same time improving the heat transmission effect to the heat radiation chambers FW, RW from the heat generating area 7 by securing a larger heat transmission area. On the other hand, as shown in FIG. 4, the rear end surface 24 of the front partitioning plate 2 is also formed with a multiplicity of effect improving grooves 25, as recesses, similar to the effect improving grooves 37. The effect improving grooves 25 have the same function as the effect improving grooves 37.

As shown in FIG. 5, the front end surface 34 of the rear partitioning plate 3 is further formed with a recessed supply groove 38 and a recovery groove 39. The supply groove 38 is extended and inclined forward of the diametrical line L1 (FIG. 6) in the direction of rotor rotation, and has the base end portion thereof communicating with the transfer opening 35. The recovery groove 39, on the other hand, extends inclined rearward of the diametrical line L1 (FIG. 6) in the direction of rotor rotation, while the base end portion thereof directly communicates with the arcuate portion of the boundary opening 9. The supply groove 38 introduces the silicone oil flowing in from the storage area 8 through the transfer opening 35 to the outer peripheral area of the heat generating area 7. On the other hand, the recovery groove 39 introduces the silicone oil from the outer peripheral area of the heat generating area 7 to the boundary opening 9. The depths of the three types of grooves formed in the end surface 34 of the rear partitioning plate 3, i.e. the effect improving grooves 37 (depth d1), the supply groove 38 (depth d2) and the recovery groove 39 (depth d3) hold the relation of $d1<d3<d2$.

The working chamber 6 formed by the heat generating area 7, the storage area 8 and the boundary opening 9 makes up a fluid-tight internal space of the housing of the heat generator. As described above, a predetermined amount of silicone oil constituted of a viscous fluid can be placed in the working chamber 6. The amount of the silicone oil thus filled at normal temperature is determined as 40% to 95% of the available volume in the working chamber 6 taking the thermal expansion of oil heated by shearing into account. More preferably, the oil amount is determined in such a manner that the oil level L in the storage area 8 when the rotor 17 is stationary is at least flush with the rotary axis C. Thus, at least in the storage area 8 and the boundary opening 9, the lower half portion below the oil level L has the liquid phase portion of the silicone oil, while a gas phase portion of air or inert gas exists in the remaining portion above the oil level L. In this case, too, the storage area 8 can accommodate much more of the silicone oil than the volume of the fluid-tight gap between the partitioning walls 24, 34 of the working chamber and the rotor 17 in the heat generating area 7. By the way, in spite of this somewhat small oil filling rate, the silicone oil below the liquid level L in the heat generating area 7 is raised above the liquid level L by the rotor 17 due to the stretching viscosity thereof and uniformly covers the whole fluid-tight gap.

The basic operation of this heat generator is as follows. With the integral rotation of the drive shaft 16 and the rotor 17 driven by the engine E, the silicone oil is sheared and generates heat in the fluid-tight gap at each end surface (shearing surface) of the rotor 17 and the partitioning walls 24, 34 of the heat generating area 7. The heat generated in the heat generating area 7 passes to the circulation water flowing in the front and rear water jackets FW, RW through the partitioning plates 2, 3. The circulation water heated by the jackets FW, RW is used, for heating the passenger compartment, by the heating circuit 11.

While the rotor 17 is driven in the heat generator, the effect of the rotation of the rotor 17 in the heat generating area 7, i.e. the effect of agitation of the rotor 17 in rotation is transmitted to the oil in the storage area 8 through the silicone oil liquid phase portion below the liquid level L of the boundary opening 9. Then, the oil runs free in the same direction in the storage area 8, and most of the free-running oil impinges on the guide units (the side portion k of the protruded wall and the screen 41) immersed in the oil below the liquid level L and changes the direction of flow, so that the oil is forcibly led toward the transfer opening 35. The oil led to the heat generating area 7 through the transfer opening 35 is guided to the outer peripheral portion (the area where heat is generated relatively actively) of the heat generating area 7 by the supply groove 38, while at the same time uniformly covering the whole fluid-tight gap. Specifically, the transfer opening 35, the side portion k of the protruded wall 36, the screen 41 and the supply groove 38 below the liquid level L make up supply means for transferring the viscous fluid from the storage area 8 to the heat generating area 7.

The silicone oil that has come to uniformly cover the whole heat generating area 7 is returned to the storage area 8 through the gas phase portion of the boundary opening 9 above the liquid level L. Most of the oil in the heat generating area 7, however, is trapped by the recovery groove 39 with the rotation of the rotor 17, and returned to the storage area 8 through the gas phase portion of the boundary opening 9 and the base end portion of the recovery groove 39 located above the liquid level L. Specifically, the gas phase portion of the boundary opening 9 and the recovery groove 39 make up the recovery means for transferring the viscous fluid from the heat generating area 7 to the storage area 8. In this way, the transfer opening 35 and other component parts below the liquid level L form an oil supply path from the storage area 8 to the heat generating area 7, while the boundary opening 9 above the liquid level L forms a substantial oil recovery path to the storage area 8 from the heat generating area 7. As long as the rotor 17 is in rotation, therefore, the replacement/circulation of the viscous fluid is maintained between the storage area 8 and the heat generating area 7 of the working chamber 6.

The outflow ratio $\alpha$ and the balance between inflow and outflow of the viscous fluid between the heat generating area 7 and the storage area 8, if the heat generator is mounted on the vehicle body at the mounting angle shown in FIG. 6, and the liquid level L of the oil is located at the position indicated by two-dot chain line, will be discussed.

(1) Oil flow from storage area 8 into heat generating area 7.

The main driving factors for the oil flowing from the storage area 8 through the transfer opening 35 and the supply groove 38 into the heat generating area 7 include the forcible transfer function of the supply groove 38 when the rotor is rotating (Qin1), the weight of the oil in the storage area acting at the entrance point C1 of the supply groove 38 lower than the liquid level L (Qin2), and the pressure gradient between the ends of the supply groove 38 (Qin3). The total of these three driving factors makes up the total inflow rate (Qin) into the heat generating area 7 (Equation (1)).

$$Qin = Qin1 + Qin2 + Qin3 \tag{1}$$

In FIG. 6, if the center C1 of the transfer opening 35 is regarded as the base point (entrance point) of the supply groove 38, and the base point (exit point) of the recovery groove 39 is at C2, the points C1 and C2 are located on the partitioning circle D1, and the points C1, C and C2 are located on the vertical first diametrical line L1. L2 is the center line of the supply groove 38 intersecting the first diametrical line L1 at the entrance point C1. When the rotor 17 is in rotation, the outermost peripheral edge of the rotor plots the arcuate trace D2 indicated by dashed line in FIG. 6. Let the intersection between the arcuate trace D2 and the groove center line L2 be C3. Then, L3 is the second diametrical line connecting the intersection C3 and the rotary axial center C. While the rotor 17 is rotating, a point P (not shown) on the rotor opposed to the entrance point C1 of the supply groove 38 plots a trace overlapped with the partitioning circle D1. Assuming that the radius of the circle plotted by the point P on the rotor is a, the radius a corresponds to the distance between C1 and C which should be considered as a groove entrance radius. Also, if the radius of the rotor 17 is b, the radius b corresponds to the distance between C3 and C which should be considered as the radius out of the rotor. Also, if the angle formed by the first diametrical line L1 and the groove center line L2 (nominal groove angle) is θi, and the angle formed by the groove center line L2 and the second diametrical line L3 (effective groove angle of the radial position out of the rotor) is θo. Further, if the ratio of the circumference of a circle to its diameter is π, the angular velocity of the rotor 17 be Ω, the width of the supply groove 38 is w, and the depth of the supply groove 38 is h. Strictly, the groove depth h is the depth from the end surface 34 to the bottom surface of the groove 38 plus the clearance between the end surface 34 and the shearing surface of the rotor 17. Nevertheless, this clearance is so narrow that it is impracticable to take it into account to calculate the groove depth h.

The average velocity v1 of the oil moving from point C1 toward C3 along the supply groove 38 and the flow rate Qin due to the forcible transfer function of the supply groove 38 are given by equations (2) and (3) below.

$$v1 = (\Omega/2) \times (a \cdot \cos(\pi/2 - \theta i) + b \cdot \cos(\pi/2 - \theta o))/2 \tag{2}$$

$$\begin{aligned} Qin1 &= wh \times v1 \\ &= wh\Omega(a \cdot \cos(\pi/2 - \theta i) + b \cdot \cos(\pi/2 - \theta o))/4 \end{aligned} \tag{3}$$

As shown in FIG. 6, the height of the oil level L in the storage area 8 based on the entrance point C1 of the supply groove 38 is assumed to be H. Let g be the acceleration due to gravity. Then, the velocity v2 of the oil due to its own weight at the entrance point C1 and the flow rate Qin2 of the oil due to its own weight at the entrance point C1 are given by equations (4) and (5).

$$v2 = (2gH)^{1/2} = \sqrt{2gH} \tag{4}$$

$$Qin2 = wh \times v2 = wh\sqrt{2gh} \tag{5}$$

Further, let Po be the pressure of the liquid phase portion on the outer periphery of the heat generating area 7, Pi be the pressure of the gas phase portion of the storage area 8, ΔP (=Po−Pi) be the pressure difference between Po and Pi, ρ be the density of the silicone oil, and $\mu$ be the viscosity of the silicone oil. The pressure at the point C1 on the storage area 8 side is given as (Pi+ρgH). Also, the flow rate Qin3 due to the pressure gradient between the ends of the supply groove 38 when the rotor is in rotation is given by equation (6).

$$\begin{aligned} Qin3 &= -\{wh^3(Po - (Pi + \rho gH))\}/12\mu(b-a) \\ &= -(wh^3(\Delta P - \rho gH))/12\mu(b-a) \end{aligned} \tag{6}$$

Since the equation (6) assumes a negative value, the pressure gradient works in the direction of reversing the oil inflow from the storage area 8 to the heat generating area 7.

(2) Oil flow out of heat generating area 7 to storage area 8.

The main driving factors involved in the oil flowing out of the heat generating area 7 through the recovery groove 39 or the like to the storage area 8 include the forcible transfer function of the recovery groove 39 while the rotor is in rotation (Qout1) and the pressure gradient between the ends of the recovery groove 39 (Qout2). The sum of these two driving factors constitutes the total amount of outflow (Qout) from the heat generating area 7 (equation (7)).

$$Qout = Qout1 + Qout2 \tag{7}$$

As described above, C2 in FIG. 6 indicates the base point (exit point) of the recovery groove 39 located on the vertical first diametrical line L1. L4 is the center line of the recovery groove 39 crossing the first diametrical line L1 at the exit point C2. The intersection between the arcuate trace D2 plotted by the outermost peripheral edge of the rotor and the groove center line L4 is assumed to be C4. L5 is the third diametrical line connecting the intersection C4 and the rotary axis C. While the rotor 17 is in rotation, a point P (not shown) on the rotor in an opposed relation to the exit point C2 of the recovery groove 39 plots a trace overlapped with the partitioning circle D1. Let a be the radius of the circle plotted by the point P on the rotor. Then, a corresponds to the distance between C and C2 which should be regarded as "the groove exit radius". Also, the radius b of the rotor 17 corresponds to the distance between C and C4 which should be regarded as "the radius of rotor". The angle (nominal groove angle) formed between the first diametrical line L1 and the groove center line L4 is assumed to be θi', and the angle (effective groove angle at radius out of the rotor) between the groove center line L4 and the third diametrical line L5 is assumed to be θo'. Further, let Ω be the angular velocity of the rotor 17, w' be the width of the recovery groove 39, and h' be the depth of the recovery groove 39. The depth h' is strictly defined as the depth from the end surface 34 to the bottom surface of the groove 39 plus the clearance between the end surface 34 and the shearing surface of the rotor 17. The clearance, however, is so narrow that it is not practical to take the clearance into account in determining the groove depth h'.

Then, the average speed v3 of the oil moving from point C4 toward point C2 along the recovery groove 39 and the flow rate Qout1 due to the forcible transfer function of the recovery groove 39 are expressed by equations (8) and (9) below.

$$v3=(\Omega/2)\times(a\cdot\cos(\pi/2-\theta i')+b\cdot\cos(\pi/2-\theta o'))/2 \quad (8)$$

$$Qout1 = w'h'\times v3 \quad (9)$$

$$= (w'h'\Omega)(a\cdot\cos(\pi/2-\theta i')+b\cdot\cos(\pi/2-\theta o'))/4$$

Further, as in the aforementioned case, assuming that the pressure difference between the pressure Po of the liquid phase portion on the outer periphery of the heat generating area 7 and the pressure Pi of the gas phase portion of the storage area 8 is ΔP (=Po−Pi), the flow rate Qout2 due to the pressure gradient between the ends of the recovery groove 39 is given by equation (10) below.

$$Qout2 = (w'h'^3(Pi-Po))/12\mu(b-a) \quad (10)$$

$$= (w'h'^3\Delta P)/12\mu(b-a) > 0$$

(3) Analysis of inflow/outflow balance and outflow ratio α.

In the case where the heat generator is running steadily with a stable heat generating amount, the total inflow and the total outflow are in equilibrium (Qin=Qout). As long as this equilibrium is maintained, equation (11) holds and can be rearranged to express the pressure difference ΔP as shown in equation (12) below.

$$Qin1+Qin2+Qin3=Qout1+Qout2 \quad (11)$$

$$\Delta P=\{(12\mu(b-a))/(wh^3+w'h'^3)\}(Qin1+Qin2-Qout1)+wh^3\rho gH/(wh^3+w'h'^3) \quad (12)$$

The parameters including Qin1 in equation (3), Qin2 in equation (5), Qout1 in equation (9) and ΔP in equation (12), except for the rotor angular velocity Ω, are uniquely determined by selecting the shape, position and mounting angle of each groove and the type and filling rate of oil in design stage. In other words, once the appropriate assumed angular velocity Ω is given, the values including Qin1, Qin2, Qout1 and ΔP can be determined by calculations. Upon determination of ΔP in this way, Qin3 can also be determined from equation (6), so that the total inflow rate Qin of equation (1) can be determined from the values Qin1, Qin2 and Qin3.

As long as the oil replacement/circulation in the heat generator is in equilibrium, the ratio of the total outflow rate to the total inflow rate (Qout/Qin) is unity. The relation Qout/Qin=1, however, indicates simply the equilibrium between inflow and outflow but not the oil filling rate (or occupancy) in the fluid-tight gap of the heat generating area 7. Among the component elements of the total outflow rate Qout shown in equation (7), the flow rate Qout1 due to the forcible transfer function of the recovery groove 39 is uniquely determined (established) once the shape, position and mounting angle of the recovery groove 39 and the rotor angular velocity Ω are specified. In contrast, the flow rate Qout2 due to the pressure gradient is proportional to ΔP (=Po−Pi) as shown in equation (10). In the case where the oil filling rate of the fluid-tight gap of the heat generating area 7 has reached 100%, however, it is very difficult to predict the subsequent change of the pressure Po of the liquid phase portion on the outer periphery of the heat generating area. Specifically, Qout is an unstable factor affected by the gas phase and the oil filling rate of the heat generating area 7 and cannot be uniquely determined theoretically. Taking the flow rate Qout2, which is very dependent on other factors, into consideration never contributes to the characteristic evaluation or design of the heat generator. Instead, if a new characteristic evaluation index capable of being numerically established theoretically is defined and the characteristics of the heat generator can be designed with such an index, then the waste of labor and time to perform trial and error studies can be avoided without fail.

In view of this, according to this embodiment, the outflow ratio α is defined as shown in equation (13).

$$\alpha=Qout1/Qin=Qout1/(Qin1+Qin2+Qin3) \quad (13)$$

The numerator of this equation representing the outflow ratio α is the flow rate Qout1 due to the forcible transfer function of the recovery groove 39. This should be understood to be the result of employing only an established factor (Qout1) excluding the subsidiary factor (Qout2) from the total outflow rate Qout. The outflow ratio α thus defined is a characteristic evaluation index that can be uniquely determined once the assumed angular velocity (Ω) of the rotor 17, the shape (h, h', w, w'), the position (a, b) and the mounting angle (θi, θi', θo, θo') of the supply groove 38 and the recovery groove 39 and the type (ρ, μ) and filling rate (H) of the viscous fluid are selected.

Figure 9:
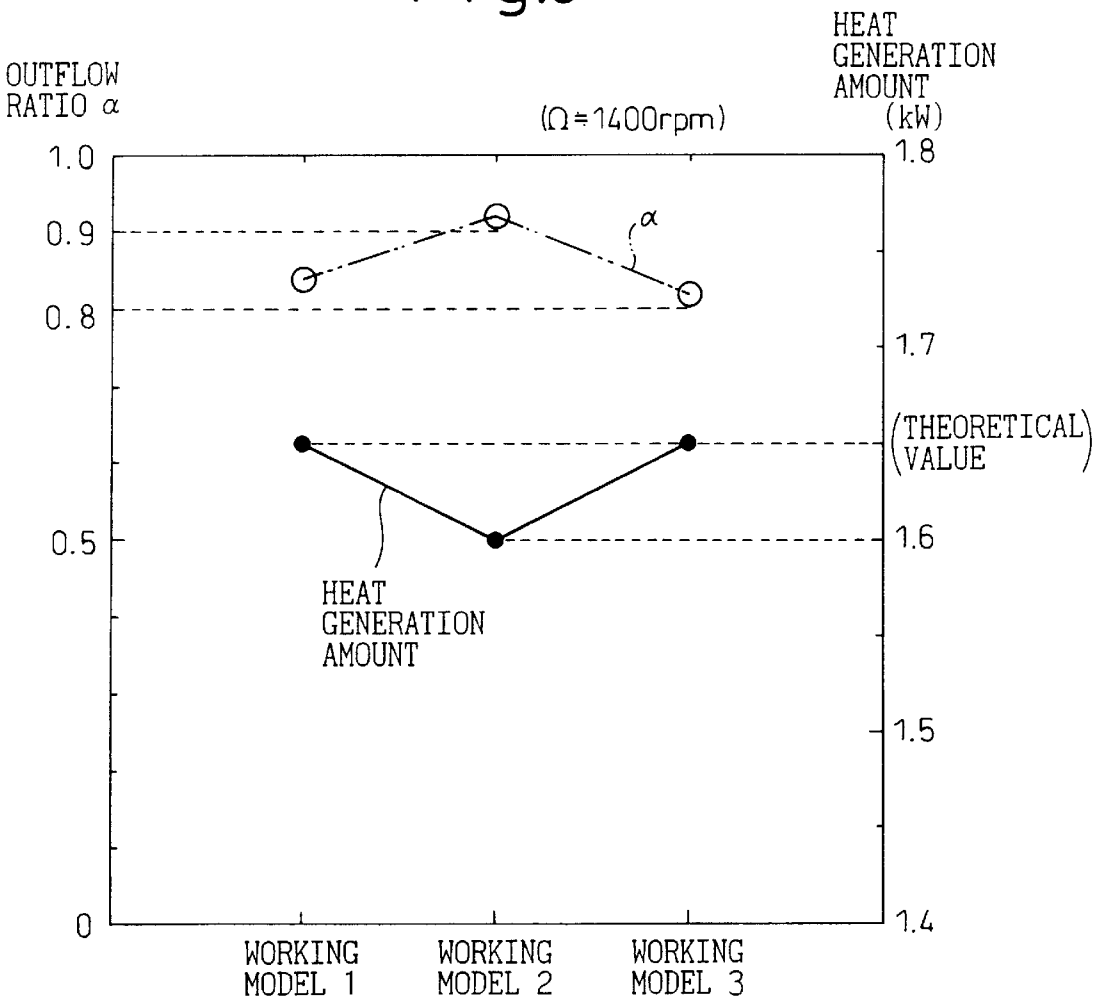
FIG. 9 is a graph showing the outflow ratio versus the heat generation amount in each working model.

It has been experimentally substantiated that the outflow ratio α can be an influential design index for setting the heat generation performance of the heat generator of this type. The graph of FIG. 9 shows the relation between the calculated outflow ratio α and the actual measurement of the heat generation amount for an assumed revolution speed (Ω=about 1400 rpm) for three working models. In the graph, the working model 1 indicates a heat generator according to the first embodiment, and the working models 2 and 3 indicate the heat generator according to the second embodiment described later. In the working model 1, the outflow ratio α is set to 0.84 with the heat generation amount of about 1.65 kw. The heat generation amount of 1.65 kw is substantially equal to the theoretical heat generation amount for the assumed revolution speed (Ω=about 1400 rpm) with the fluid-tight gap of the heat generating area 7 filled almost 100% with the oil. In the graph, the working model 2, on the other hand, is associated with the outflow ratio α of 0.92 and the heat generation amount of 1.60 kW, and the working model 3 with the outflow ratio α of 0.82 and the heat generation amount of 1.65 kW. As far as the test result on the working models 1 to 3 is concerned, it is seen that the outflow ratio α and the heat generation amount are inversely correlated. By designing the heat generator with the outflow ratio α of about 0.80 to 0.86, on the other hand, the heat generation performance substantially corresponding to the theoretical heat generation amount can be secured at the assumed revolution speed.

Taking into consideration the fact that the equation defining the outflow ratio α and Qout2 always assume a positive value, the outflow ratio α is less than unity in the case where the oil replacement/circulation is in equilibrium (Qout/Qin=1). Although it is impossible to determine what value is assumed by Qout2, it is easily estimated that the smaller the value α with the lower relative function (Qout) of the recovery groove 39, the higher the trend toward an excessive flow into the heat generating area 7, so that the inflow and outflow will be balanced with almost 100% of the oil filling rate in the heat generating area 7. It can also be easily estimated, on the other hand, that the nearer the outflow ratio α is to unity, the higher the possibility of realizing the equilibrium between inflow and outflow without attaining 100% of the oil filling rate of the heat generating area 7. The experimental result of FIG. 9 coincides with this estimation.

The first embodiment has the following advantages. By setting the shape, position and the mounting angle of the supply groove 38 and the recovery groove 39 and also by selecting the type and the filling rate of the viscous fluid so that the outflow ratio $\alpha$ is 0.84, the heat generation amount of the heat generator can be set substantially to the same value as the theoretical value for the assumed revolution speed of the rotor 17.

By designing the heat generator so that the outflow ratio $\alpha$ is 0.84, the filling rate of almost 100% of the viscous fluid in the fluid-tight gap of the heat generating area 7 can be attained at least in the case where the heat generator is in steady operation with the same assumed revolution speed. In other words, the heat generating efficiency of the heat generator can be maximized for operation at the assumed revolution speed.

The silicone oil recovered from the heat generating area 7 to the storage area 8 stays in the storage area 8 for a predetermined length of time corresponding to the cycle time of the replacement/circulation. The oil is high in temperature immediately after being recovered from the heat generating area 7. While the oil stays in the storage area, however, the heat is partly transmitted to the partitioning members (the rear partitioning plate 3 and the rear housing body 4) of the storage area 8 and thus the silicone oil is deprived of heat. As a result, the high-temperature silicone oil is cooled (quenched) and protected from the degeneration which otherwise might be caused by a protracted holding of heat.

(Second Embodiment)

Figure 7:
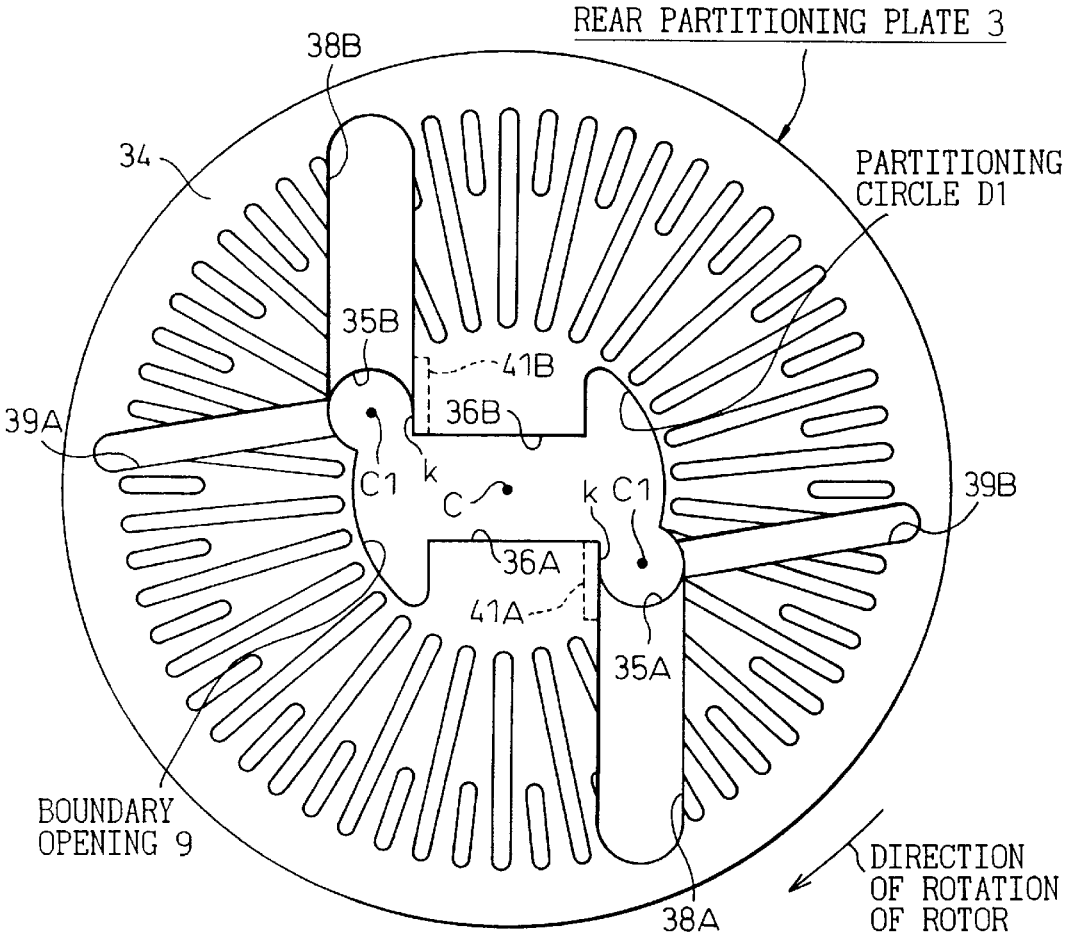
FIG. 7 is a front view corresponding to FIG. 5 showing a vehicle heat generator according to a second embodiment of the invention.
Figure 8:
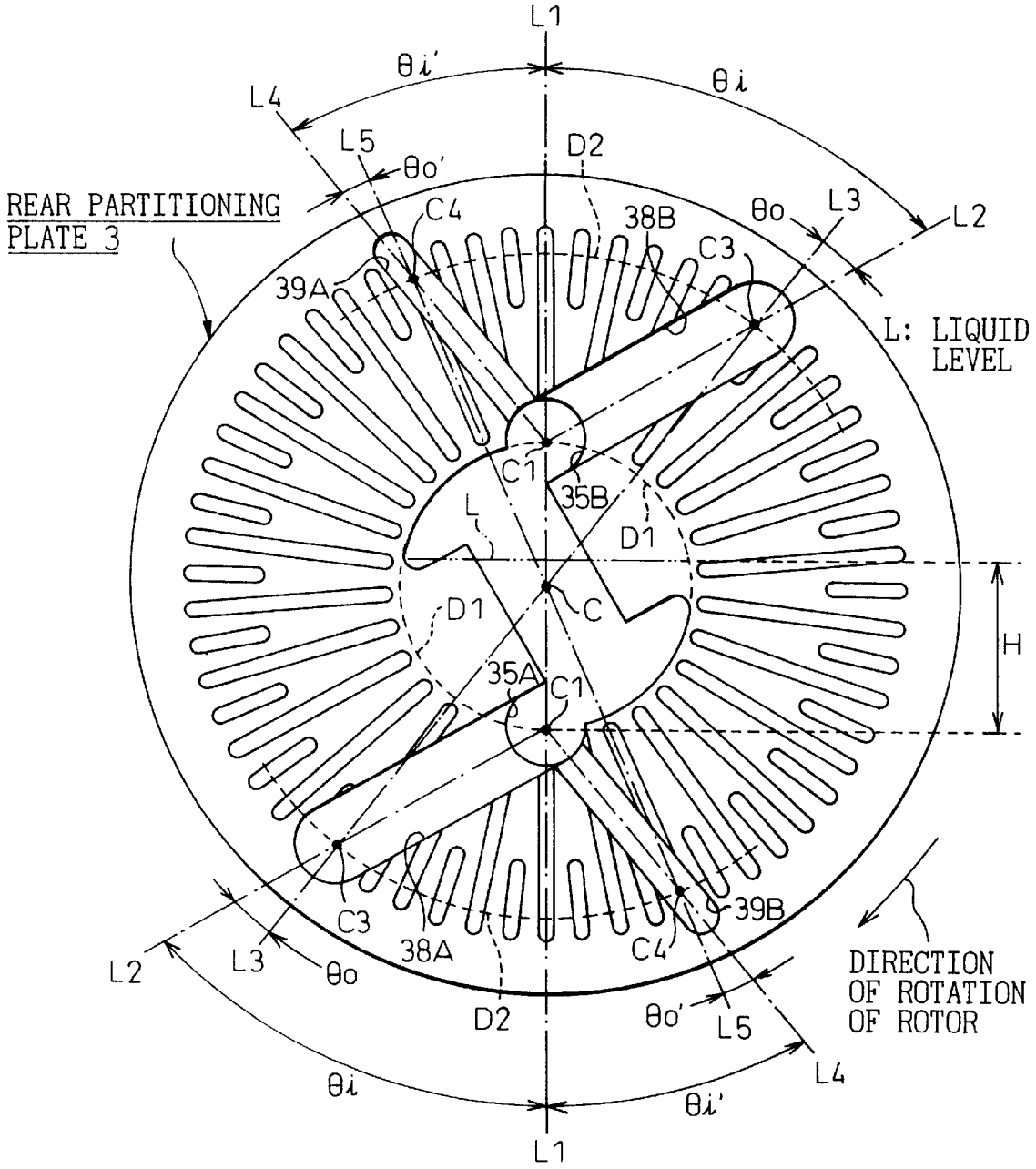
FIG. 8 is a front view of a rear partitioning plate taken from the front end when mounted on the vehicle body.

FIGS. 7 and 8 show a second embodiment of the invention. According to the first embodiment, one each of the supply groove 38 and the recovery groove 39 are formed at the end surface 34 of the rear partitioning plate 3. In the second embodiment, on the other hand, two pairs of supply and recovery grooves are formed at the plate end surface 34, and the shape of the boundary opening 9 is changed accordingly. In order to avoid the duplication of the explanation, only the points different from the first embodiment will be mainly explained. The configuration and operations not specifically referred to in the description that follows should be understood to be similar to the corresponding configuration and operations of the first embodiment.

As shown in FIG. 7, the outline of the boundary opening 9 is formed substantially along the partitioning circle D1 of a predetermined radius (a) about the rotary axis C. The rear partitioning plate 3 is formed with two notches making up two substantially circular transfer openings 35A, 35B in such a manner as to extend out of the partitioning circle D1. The two openings 35A, 35B are located substantially symmetrically about a point on the rotary axis C. The center C1 of each opening is located on the partitioning circle D1, and the two centers C1 and C are located on the first diametrical line L1 (FIG. 8).

As shown in FIG. 7, two substantially rectangular walls 36A, 36B protrude from the inner peripheral surface of the cylindrical portion 32 of the rear partitioning plate 3. The two protruded walls 36A, 36B are arranged substantially symmetrically about a point on the rotary axis C and extend toward the rotary axis C to approach to each other. The protrusion height of each protruded wall 36A, 36B is less than the radius of the partitioning circle D1 and therefore a space remains between the protruded walls 36A, 36B. The protruded walls 36A, 36B are substantially rectangular, and therefore the boundary opening 9 is substantially H-shaped and defined by the partitioning circle D1 and the two protruded walls 36A, 36B as viewed from the front or rear sides. In other words, the boundary opening 9 is comprised of a pair of the transfer openings 35A, 35B and the substantially H-shaped opening constituting the remainder thereof. The area of the boundary opening 9 is sufficiently large for the silicone oil to flow freely in the storage area 8 under the effect of the rotation of the rotor existing in the heat generating area 7. In the case where the required amount of silicone oil (viscous fluid) is put in the working chamber 6, the portion of the boundary opening 9 lower than the oil level L (FIG. 8) substantially constitutes a liquid phase portion capable of transmitting the effect of the rotation of the rotor 17 from the silicone oil in the heat generating area 7 to the silicone oil in the storage area 8 and thus permitting the silicone oil to flow freely.

As shown in FIG. 7, the protruded walls 36A, 36B each have a side portion k near to the corresponding transfer openings 35A, 35B, respectively. Also, in addition to the side portion k of the protruded walls 36A, 36B, a pair of screens 41A, 41B are arranged in the storage area 8. The screens 41A, 41B are arranged symmetrically about a point on the rotary axis C. Also, the screens 41A, 41B are protruded rearward from the side portion k near the transfer opening of the protruded walls 36A, 36B in the rear surface (the surface on the storage area 8 side) thereof. The side portion k of the protruded walls 36A, 36B nearer to the transfer opening is located downstream of the corresponding transfer openings 35A, 35B in the silicone oil flowing in the storage area 8. The screens 41A, 41B each extend in the same direction as the corresponding supply grooves 38A, 38B and, like the screen 41 of FIG. 1, has an axial length somewhat shorter than the axial length of the storage area 8. With the rotation of the rotor 17, the silicone oil, flowing freely in the direction of rotor rotation in the storage area 8 and impinging on any one of the screens, changes course in the axial direction along the particular screen, and thus is forcibly transferred toward the corresponding transfer opening. Specifically, the screens 41A, 41B support the function of the side portion k of the protruded walls 36A, 36B. These parts function as a guide for changing the direction of flow of the silicone oil in the storage area 8 and leading the silicone oil to the heat generating area 7 through the transfer opening.

The end surface 34 of the rear partitioning plate 3 is formed further with two supply grooves 38A, 38B and two recovery grooves 39A, 39B. The two supply grooves 38A, 38B are arranged about a point on the rotary axis C, and so are the two recovery grooves 39A, 39B. One supply groove and one recovery groove are assigned to each pair of the transfer openings 35A, 35B. Specifically, for the transfer opening 35A, the supply groove 38A extends inclined forward in the rotational direction of the rotor and communicates with the opening 35A, while the recovery groove 39B is extended and inclined rearward in the rotational direction of the rotor and communicates with the opening 35A. Similarly for the transfer opening 35B, the supply groove 38B and the recovery groove 39A communicate. The supply grooves 38A, 38B introduce, into the outer peripheral area of the heat generating area 7, the silicone oil flowing in from the storage area 8 through the corresponding transfer opening. On the other hand, the recovery grooves 39A, 39B introduce the silicone oil on the outer peripheral area of the heat generating area 7 to the corresponding transfer opening.

The required amount of silicone oil constituting the viscous fluid is put in the working chamber 6 including the heat generating area 7, the storage area 8 and the boundary opening 9. According to the second embodiment, the oil amount is determined in such a manner that the oil level L in the storage area 8 is not less than the level of the rotary axis C when the rotor 17 is stationary (FIG. 8). This is in order to locate one of the two transfer openings 35A, 35B at a position lower than the oil level L, and the other opening at a position above the oil level L.

The heat generator according to the second embodiment is mounted on the vehicle body at the mounting angle shown in FIG. 8, for example, and when the engine E is driven, operates in the same manner as in the first embodiment. Specifically, the effect of rotation (agitation effect of the rotor 17) in the heat generating area 7 is transmitted to the silicone oil in the storage area 8 through the liquid phase portion of the silicone oil occupying the lower half of the boundary opening 9 so that the oil in the storage area 8 flows freely in the same direction. Then, most of the oil flowing in the storage area 8 under the effect of the rotor impinges on the guide units (i.e. the side portion k of the protruded wall 36A and the screen 41A) immersed in the oil lower than the oil level L and, after changing the direction of flow, is forcibly led toward the transfer opening 35A corresponding to the particular guide unit. The oil led to the heat generating area 7 through the transfer opening 35A is uniformly distributed over the fluid-tight gap by the supply groove 38A.

On the other hand, the silicone oil that has been uniformly distributed over the heat generating area 7 can be returned to the storage area 8 through the gas phase portion of the boundary opening 9 higher than the liquid level L. Most of the oil in the heat generating area 7, however, is trapped by the recovery groove 39A connecting to the transfer opening 35B located above the liquid level L, and through the particular transfer opening 35B, returned to the storage area 8. During the rotor operation, the recovery groove 39B connected to the transfer opening 35A lower than the liquid level L also attempts to collect and send the oil to the transfer opening 35A. In view of the fact that the pressure of oil flowing into the heat generating area 7 from the transfer opening 35A by means of the side portion k of the protruded wall 36A and the screen 41A far surpasses the oil pressure due to the recovery groove 39B, however, the recovery groove 39B apparently fails to function.

As long as the rotor 17 is in rotation under the condition shown in FIG. 8, the transfer opening 35A lower than the oil level L functions as an oil supply path from the storage area 8 to the heat generating area 7, while the transfer opening 35B above the oil level L functions substantially as an oil recovery path from the heat generating area 7 to the storage area 8. Thus, the supply groove 38A, in cooperation with the transfer opening 35A providing an oil supply path, clearly exhibits its full ability, so that the recovery groove 39A connected to the transfer opening 35B constituting an oil recovery path can also exhibit its full ability. The supply groove 38B and the recovery groove 39B, on the other hand, apparently enter the dormant state. This is due to the special situation in which the grooves 38A, 39B communicate with the same transfer opening 35A and the grooves 38B, 39A communicate with the same transfer opening 35B. Specifically, the transfer opening 35A below the oil level L and the corresponding guide units (the side portion k of the protruded wall 36A and the screen 41A) constitute an oil supply path from the storage area 8 to the heat generating area 7, and the remaining portion of the boundary opening 9 (especially, the other transfer opening 35B constituting a part of the gas phase portion of the boundary opening 9) except for the transfer opening 35A constituting the oil supply path make up an oil recovery path from the heat generating area 7 to the storage area 8. As a result, as long as the rotor 17 is in rotation, the replacement/circulation of silicone oil is maintained between the heat generating area 7 and the storage area 8 of the working chamber 6.

Next, the outflow ratio $\alpha$ of the heat generator according to the second embodiment will be explained with reference to FIG. 8.

In FIG. 8, the center C1 of each of the two transfer openings 35A, 35B can be regarded as the base point (entrance point) of the corresponding supply groove and the base point (exit point) of the corresponding recovery groove, respectively. Specifically, C1 in FIG. 8 corresponds to C1 and C2 in FIG. 6. Two C1s are located on the partitioning circle D1, and C1, C are located on the vertical first diametrical line L1. L2 is the center line of each of the supply grooves 38A, 38B crossing the first diametrical line L1 at the entrance point C1. C3 is the intersection between the arcuate trace D2 plotted by the outermost peripheral edge of the rotor 17 and the groove center line L2, and L3 is the second diametrical line connecting each intersection C3 and the rotary axis C. L4 is the center line of each of the recovery grooves 39A, 39B crossing the first diametrical line L1 at the exit point C1. C4 is an intersection between the arcuate trace D2 plotted by the outermost peripheral edge of the rotor 17 and the groove center line L4, and L5 is the third diametrical line connecting each intersection C4 and the rotary axis C. The nominal groove angle $\theta i$ is an angle formed by the first diametrical line L1 and the groove center line L2, and the effective groove angle $\theta o$ is an angle formed by the groove center line L2 and the second diametrical line L3. Also, the nominal groove angle $\theta i'$ is an angle formed by the first diametrical line L1 and the groove center line L4, and the effective groove angle $\theta o'$ is an angle formed by the groove center line L4 and the third diametrical line L5.

The main driving factors which cause the oil in the storage area 8 to flow into the heat generating area 7 include the forcible transfer function of the two supply grooves 38A, 38B when the rotor is in rotation (2×Qin1), the weight of the oil itself in the storage area acting at the entrance point C1 of the supply groove 38A under the liquid level L (Qin2), the pressure gradient between the ends of the supply groove 38A below the liquid level L (Qin3), and the pressure gradient between the ends of the supply groove 38B above the liquid level L (Qin4). The total sum of these four driving factors represents the total oil flow rate (Qin) into the heat generating area 7 (equation (14)).

$$Qin=2\times Qin1+Qin2+Qin3+Qin4 \tag{14}$$

The flow rate Qin1 due to the forcible transfer function of one supply groove is as shown in equation (3). The flow rate Qin2 due to the weight of the oil itself at the entrance point C1 of the supply groove 38A is the same as shown in equation (5). The flow rate Qin3 due to the pressure gradient in the supply groove 38A is also the same as equation (6). On the other hand, the flow rate Qin4 due to the pressure gradient of the supply groove 38B opened to gas phase at the entrance point C1 located above the liquid level L is expressed as shown in equation (15) below.

$$Qin4=(wh^3(Po-Pi))/12\mu(b-a)=-wh^3\Delta P/12\mu(b-a) \tag{15}$$

Since both equations (6) and (15) assume a negative value, the pressure gradient in the supply grooves 38A, 38B operate in the direction against the oil flow into the heat generating area 7.

The main driving factors for the oil outflow from the heat generating area 7 to the storage area 8 include the forcible transfer function of the two recovery grooves 39 while the rotor is in rotation (2×Qout1), the pressure gradient between the ends of the recovery groove 39A above the liquid level L (Qout2), and the pressure gradient between the ends of the recovery groove 39B below the liquid level L (Qout3). The total sum of these three driving factors represents the total outflow (Qout) from the heat generating area 7 (equation (16)).

$$Qout=2\times Qout1+Qout2+Qout3 \quad (16)$$

The flow rate Qout1 due to the forcible transfer function of one recovery groove is as shown in equation (9). The flow rate Qout2 due to the pressure gradient of the recovery groove 39A is also the same as shown in equation (10). On the other hand, the flow rate Qout3 due to the pressure gradient of the recovery groove 39B located below the liquid level L with the entrance point C1 thereof in the liquid phase is expressed by equation (17).

$$Qout3 = -\{w'h'^3((Pi+\rho gH)-Po)\}/12\mu(b-a) \quad (17)$$
$$= -w'h'^3(-\Delta P+\rho gH)/12\mu(b-a)$$

The flow rate Qout2 in equation (10) always assumes a positive value, but whether the flow rate Qout3 in equation (17) assumes a positive value, zero or a negative value depends on the liquid level H and the operating conditions.

In the case where the heat generator according to the second embodiment runs steadily and the heat generation amount thereof stable, the total inflow and the total outflow are in equilibrium (Qin=Qout). During this period of equilibrium, equation (18) holds and can be rearranged to express the pressure difference ΔP as in equation (19).

$$2\times Qin1+Qin2+Qin3+Qin4=2\times Qout1+Qout2+Qout3 \quad (18)$$

$$\Delta P=\{6\mu(b-a)/(wh^3+w'h'^3)\}\times(2Qin1+Qin2-2Qout1)+\rho gH/2 \quad (19)$$

The parameters including Qin1 in equation (3), Qin2 in equation (5), Qout1 in equation (9) and ΔP in equation (19), excepting the rotor angular velocity Ω, are uniquely determined by selecting the shape, position and the mounting angle of each groove and the type and filling rate of the oil at the time of design. Specifically, once a proper assumed angular velocity Ω is given, the values Qin1, Qin2, Qout1 and ΔP can be determined by calculations. Once ΔP is determined, on the other hand, Qin3 in equation (6) and Qin4 in equation (15) can also be determined by calculations, so that the total inflow Qin of equation (14) can be determined from the values Qin1, Qin2, Qin3 and Qin4. For the same reason as described with reference to the first embodiment, on the other hand, Qout2 and Qout3 attributable to the pressure gradient are unstable factors dependent to a large measure on the oil filling rate of the heat generating area 7 and cannot be easily determined uniquely theoretically. The flow rate Qout1 due to the forcible transfer function of each recovery groove, on the other hand, can be uniquely determined (established) once the shape, position and the mounting angle of the recovery groove 39 and the rotor angular velocity Ω are specified. Thus, as in the first embodiment, taking the flow rate (2×Qout1) into account excepting the subsidiary factors (Qout2, Qout3) from the total outflow Qout of equation (16), the outflow ratio α can be defined as a characteristic evaluation index. In other words, according to the second embodiment, the outflow ratio α can be defined as equation (20).

$$\alpha = (2\times Qout1)/Qin \quad (20)$$
$$= (2\times Qout1)/(2\times Qin1+Qin2+Qin3+Qin4)$$

The outflow ratio α thus defined can be uniquely obtained from calculations by selecting the assumed angular velocity (Ω) of the rotor 17, the shape (h, h', w, w'), position (a, b) and the mounting angle (θi, θi', θo, θo') of the supply grooves 38A, 38B and the recovery grooves 39A, 39B and the type (ρ, μ) and the filling rate (H) of the viscous fluid appropriately. By the way, the study based on equations (14) to (20) is generally applicable to the case in which the supply groove and the recovery groove are not connected to the same single transfer opening.

As described above, the graph of FIG. 9 shows the relation between the outflow ratio α calculated for each working model and the actual measurement of the heat generation amount at an assumed revolution speed (Ω=about 1400 rpm). In the graph, the working models 2 and 3 are the heat generators according to the second embodiment. In the working model 2, the outflow ratio α is set to 0.92, and in the working model 3, it is set to 0.82. The position (a, b) and the mounting angle (θi, θi', θo, θo') of the supply groove and the recovery groove and the type (ρ, μ) and the filling rate (H) of the viscous fluid are all identical in the working models 2 and 3. Only the shape (h, h', w, w') of the supply groove and the recovery groove are different between the working models 2 and 3. Specifically, the width w' of the recovery groove of the working model 2 is larger than the width w' of the recovery groove of the working model 3, while the depth h' of the recovery groove of the working model 2 is shallower than the depth h' of the recovery groove of the working model 3. On the other hand, the working models 2 and 3 have the same width w of the supply groove, while the depth h of the supply groove of the working model 2 is shallower than the depth h of the supply groove of the working model 3. In other words, by slightly changing the setting of the three parameters h, h' and w', the outflow ratio α can be differentiated by about 0.1. In the working model 2 with the outflow ratio α of more than 0.86, on the other hand, a suitable heat generation amount (1.6 kW) can be secured to provide a feasible auxiliary heat source. This heat generation amount, however, is not always satisfactory. In the working model 3 having the outflow ratio α of not more than 0.86, on the other hand, a heat generation amount (about 1.65 kW) can be secured which is substantially equal to the theoretical heat generation amount at the assumed revolution speed (Ω=about 1400 rpm) in the case where the oil filling rate in the fluid-tight gap of the heat generating area 7 is about 100%.

With the heat generator according to the second embodiment, an effect similar to that of the first embodiment can be obtained by setting the shape, position and the mounting angle of the supply groove and the recovery groove and selecting the type and filling rate of the viscous fluid in such a manner as to secure the outflow ratio α of 0.82.

Equivalent pairs of elements (35A & 35B; 36A & 36B; 38A & 38B; 39A & 39B; 41A & 41B) are each arranged on the rear partitioning plate 3 symmetrically about a point on the rotary axis C. As a result, regardless of the angle at which the heat generator is mounted around the axis C on the vehicle body on condition that the oil level L is not lower than the axis C, one of the two transfer openings 35A, 35B and the element corresponding to the opening thereof can be always arranged at a level not higher than the liquid level L.

In other words, the allowable range of the mounting angle of the heat generator can be 360° without adversely affecting the oil replacement/circulation function. Thus, this configuration can remarkably improve the latitude of mounting the heat generator on the vehicle body for an improved mounting convenience.

To summarize, the definition of the outflow ratio α in the first and second embodiments can be inductively enlarged for general applications. If it is assumed, for example, that a pair of grooves is formed by one supply groove at the end surface 34 of the rear partitioning plate 3 and one corresponding recovery groove and if N pairs of grooves are formed at the plate end surface 34, the outflow ratio α of the heat generator involved is defined as $$\alpha = N \times Q\text{out}\mathbf{1}/Q\text{in} \tag{21}$$

In equation (21) above, Qin is the total inflow of the viscous fluid from the storage area 8 into the heat generating area 7, and Qout1 is the outflow due to the forcible transfer function per recovery groove. For practical purposes, however, N=1 (first embodiment) or N=2 (second embodiment) suffices. The value N of 3 or more, which complicates the shape and increases the production cost, is low in practicability.

The embodiments described above can be modified as follows.

The screens 41, 41A, 41B included in the first and second embodiments can be eliminated, and the guide unit can be configured only with the side portion k of the protruded walls 36, 36A, 36B.

The "viscous fluid", which is indicative of all the media for generating the heat from the fluid friction in the shearing operation of the rotor, is not limited to a liquid or semi-fluid of high viscosity and, of course, is not limited to silicone oil.

As described in detail above, according to the present invention, there is provided a heat generator in which the replacement/circulation of the viscous fluid can be maintained between the heat generating area and the storage area of the working chamber while the required heat generating performance can be easily secured at the same time. Also, the design method according to the invention facilitates the designing of a heat generator without trials and errors, in which the replacement/circulation and the required heat generation performance can be both secured at the same time. While the invention has been described by reference to specific embodiments chosen for purposes of illustration, it should be apparent that numerous modifications could be made thereto by those skilled in the art without departing from the basic concept and scope of the invention.

What is claimed is:

1. A heat generator comprising a working chamber defined in a housing, a viscous fluid accommodated in the working chamber, and a rotor rotationally driven by an external power, wherein the working chamber includes a heating generating area for accommodating the rotor in such a manner as to secure a fluid-tight gap between a partitioning wall and the rotor and for generating heat by shearing the viscous fluid existing in the fluid-tight gap by the rotor, a storage area for accommodating the viscous fluid exceeding the volume of the fluid-tight gap, and at least one opening formed in the boundary between the heat generating area and the storage area for communicating the two areas, wherein the working chamber includes supply means for transferring the viscous fluid in the storage area to the heat generating area at the time of rotation of the rotor and recovery means for transferring the viscous fluid in the heat generating area to the storage area at the time of rotation of the rotor, wherein the recovery means includes at least a recovery groove formed in the partitioning wall of the working chamber in opposed relation to the shearing surface of the rotor for trapping the viscous fluid existing in the fluid-tight gap and forcibly transferring it toward the opening at the time of rotation of the rotor, and wherein said supply means and said recovery means are so constructed that the outflow ratio (α), i.e. the ratio of the amount of the viscous fluid flowing out of the heat generating area due to the forcible transfer operation of the recovery groove to the total amount of the viscous fluid flowing into the heat generating area from the storage area due to the transfer function of the supply means, is not more than 0.92.

2. A heat generator according to claim 1, wherein said outflow ratio α is expressed as α=N·Qout1/Qin, where N is the number of recovery grooves, Qout1 is the amount of the viscous fluid flowing out by a recovery groove, and Qin the total amount of the viscous fluid flowing in by the supply means.

3. A heat generator according to claim 1, wherein said outflow ratio α is set in the range of 0.50 to 0.92.

4. A heat generator according to claim 1, wherein said supply means includes at least one supply groove formed in the partitioning wall of the working chamber in opposed relation to the shearing surface of said rotor for pulling the viscous fluid from said opening into the heat generating area and forcibly transferring said viscous fluid toward the outer peripheral area of the heat generating area when the rotor is in rotation.

5. A heat generator according to claim 1, wherein said recovery groove is inclined rearward in the direction of rotation of the rotor from the diametrical line extending along the diameter of the working chamber.

6. A heat generator according to claim 1, wherein said supply groove is inclined forward in the direction of rotation of the rotor from the diametrical line extending along the diameter of the working chamber.

7. A heat generator according to claim 1, wherein said opening formed in the boundary between the heat generating area and the storage area has such an area that the viscous fluid in the storage area can flow under the effect of the rotation of the rotor in said heat generating area.

8. A heat generator according to claim 1, wherein said supply means include a guide unit arranged in the storage area of the working chamber for changing the direction of flow of the viscous fluid in said storage area and leading said viscous fluid to the heat generating area through said opening.

9. A heat generator according to claim 8, wherein said guide unit includes at least a screen protruded from a member defining said storage area.

10. A method of designing a heat generator comprising a working chamber defined in a housing, a viscous fluid accommodated in said working chamber and a rotor rotationally driven by an external power, wherein circulation of the viscous fluid is possible between a heat generating area and a storage area of said working chamber, and wherein the ratio (α) of the amount of the viscous fluid flowing out through at least one recovery groove formed in the partitioning wall of the working chamber in opposed relation to the shearing surface of said rotor for trapping the viscous fluid and sending it out toward the storage area to the total amount of the viscous fluid flowing in through the supply means for supplying the viscous fluid from said storage area to said heat generating area, when the rotor is in rotation, is set to not more than 0.92.

* * * * *